United States Patent [19]

Home

[11] Patent Number: 4,681,529

[45] Date of Patent: Jul. 21, 1987

[54] AUTOMATIC ELECTRONIC IGNITION SYSTEM

[76] Inventor: William Home, 9-3 Fl., No. 374, Sec. 2, Pa Teh Road, Taipei, Taiwan

[21] Appl. No.: 867,682

[22] Filed: May 28, 1986

[51] Int. Cl.[4] ..... F23N 5/00

[52] U.S. Cl. ..... 431/74; 361/257; 361/263

[58] Field of Search ..... 431/46, 71, 74, 264, 431/266, 25; 361/257, 263

[56] References Cited

U.S. PATENT DOCUMENTS 4,384,845 5/1983 Hinton et al. ..... 431/46

*Primary Examiner*—Carroll B. Dority, Jr.
*Attorney, Agent, or Firm*—Lowe, Price, LeBlanc, Becker & Shur

[57] ABSTRACT

An automatic electronic ignition system comprising a D.C. source, an oscillatory circuit, a charging circuit and a sparking device. The D.C. source activates the oscillatory circuit. By means of a first transformer, this oscillation induces a current signal in the charging circuit with a potential higher than that of the original oscillatory signal. Due to the arrangement of the capacitors and coils within the charging circuit, an oscillatory discharge forms within the charging circuit. This oscillatory discharge further induces an even higher potential between the two electrodes of the sparking device by means of a second transformer. This causes sparking between the two electrodes and ignites the gas from the gas nozzles. The ignited gas ionizes the air molecules between the electrodes, thus turning off the oscillatory circuit. If, for some reason, the fire goes out, then the oscillatory circuit is turned on automatically, thereby re-igniting the gas from the gas nozzles.

2 Claims, 2 Drawing Figures

AUTOMATIC ELECTRONIC IGNITION SYSTEM

BACKGROUND OF THE INVENTION

This invention relates to an automatic electronic ignition system for barbecue sets. A typical conventional electronic ignition system is disclosed in Japanese Pat. No. 6522688 which can be seen in FIG. 2. This conventional device comprises transistors (TR), diodes, SCR's (Silicon Control Rectifiers) and transformers (T1 and T2) which constitute an oscillatory circuit (A) and a charging circuit (B) so as to continuously spark through electrodes (E). Therefore, once the switch (Sw) is closed, the circuit repeatedly sparks so as to fire the gas. However, in case that the flame goes out accidently, the conventional system cannot automatically re-ignite and thus the gas will flow out in great amounts without igniting. This, in turn could allow for the possibility of an explosion.

In order to avoid such a danger, an automatic photoelectric ignition system was developed. Although this system works well, the photoelectric sensor, which must be disposed in close proximity to the flame, can malfunction due to the smoking of the gas flame and can deteriorate due to the long term exposure to the heat radiation of the flame.

Further, referring to FIG. 2, it can be seen that the prior art uses SCR's to control sparking, SCR's however are controlled by oscillatory circuit (A). This increases the complexity of the circuits. Additionally, due to the transient state of the SCR, it is very possible for the oscillatory circuit to generate an abnormal oscillation. These are all disadvantages of the prior art.

SUMMARY

A primary object of the present invention is to provide an automatic electronic ignition system, wherein when the gas is fired, the ignition stops; and when the fire accidentally goes out, the gas will be ignited again automatically.

It is another object of the present invention to provide an automatic electronic ignition system which utilizes flames as a switch to control the action of the system.

It is a further object of the present invention to provide an automatic electronic ignition system which has simple circuitry, high efficiency and functionality.

DETAILED DESCRIPTION OF THE PREFERRED EMBODIMENT

Figure 1:
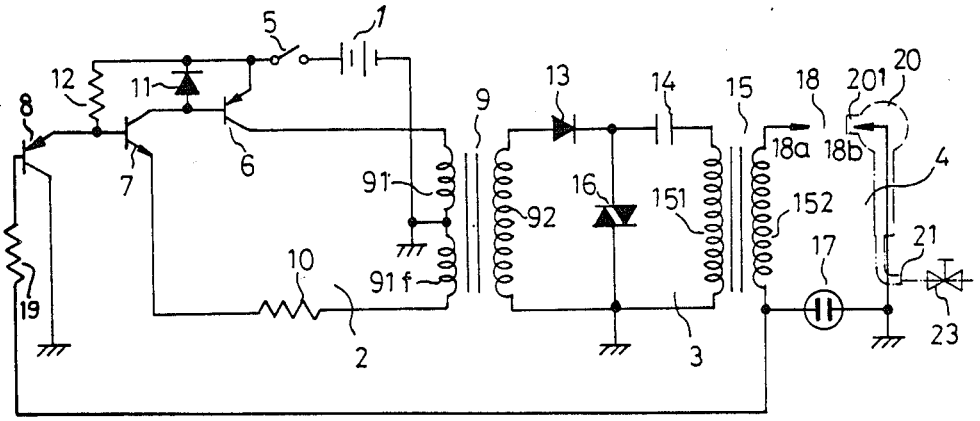
FIG. 1 is a circuit diagram of the present invention.
Figure 2:
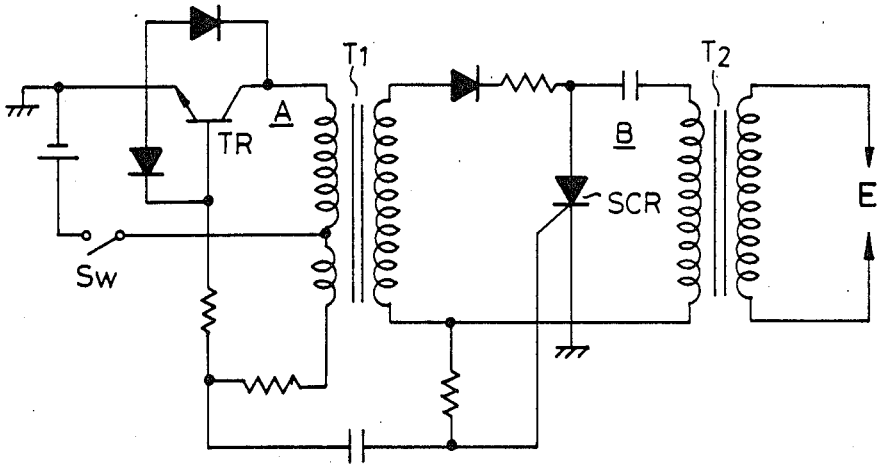
PRIOR ART FIG. 2
FIG. 2 is a circuit diagram of the prior art.

Referring to FIG. 1, it can be seen that the present automatic electronic ignition system for barbecue sets comprises a D.C. source 1, an oscillatory circuit 2, a charging circuit 3 and a sparking device 4.

The D.C. source 1 is preferably a set of dry cells which connect a switch 5 with the anode thereof.

The oscillatory circuit 2 comprises three transistors (6, 7 and 8), a diode 11, two resistors (10 and 12) and a first transformer 9. The oscillatory transistor 6 is preferably a PNP transistor whose base is connected to the collector of the transistor 7, whose emitter is connected to the anode of the D.C. source 1 via the switch 5, and whose collector is connected in series to a first coil 91 of the primary winding of the transformer 9, which is in turn connected to ground with the cathode of the D.C. source in parallel. The amplifying transistor 7 is preferably a NPN transistor whose base is connected to the emitter of the transistor 8 and whose emitter is connected to a second coil 91*f* of the primary winding of the first transformer 9 in series via resistor 10. A diode 11 further connects the base of the transistor 6 to the anode of the D.C. source via switch 5. A resistor 12 further connects the base of the transistor 7 to the anode of the D.C. source 1 via switch 5. The transistor 8 is perferably a NPN transistor whose collector is grounded.

The charging circuit 3 comprises a diode 13, a capacitor 14, a second transformer 15 and a trigger 16. One end of secondary winding 92 of the first transformer 9 is grounded and the other end is connected to the rectifying diode 13. The capacitor 14 is connected between the cathode of the rectifying diode 13 and one end of the primary winding 151 of the second transformer 15. The other end of the primary winding 151 of the second transformer 15 is grounded. A trigger 16 is disposed between the connection of the capacitor 14 and the rectifying diode 13 and the ground in parallel with the primary winding 151 of the second transformer 15 and also in parallel with the secondary winding 92 of the first transformer 9.

The sparking device 4 comprises an ignition 18, of which one electrode 18*a* connects in series with the secondary winding 152 of the second transformer 15, which in turn is grounded via a neon lamp 17 and connects in series with the base of the transistor 8 via a resistor 19. The other electrode 18*b* is grounded and disposed in close proximity to the gas nozzle 201 which is disposed on a metal outlet 20. The outlet 20 is connected with a gas valve 23 via a gas pipe 21 to be supplied with gas. The electrode 18*a* must be disposed close enough to the other electrode 18*b* that the flame ignited from gas nozzle 201 can reach it. This insures that the air between the two electrodes will be ionized by the high temperature flame to connect the electrodes (18*a* and 18 *b*) electrically.

When oscillatory circuit 2 is first switched on, the D.C. source 1 will supply a positive bias to the base of transistor 7 through resistor 12. Therefore, a forward bias between the base and the emitter of transistor 7 develops, thus turning on transistor 7. Meanwhile, the potential at the base of transistor 6 is lower than that of the emitter of transistor 6 (due to resistor 12) and is higher than that of the collector of transistor 6 (due to resistor 10). Under these circumstances, the transistor 6 is in an active region and a current flows through the first coil 91 of the primary winding of the first transformer 9 to the ground. An induced current is therefore generated within the second coil 91*f* of the primary winding of first transformer 9 which flows to the base of transistor 6 through resistor 10 and transistor 7. The current signal is then amplified and sent back to the first coil 91. Thus, an oscillation is generated within the oscillatory circuit 2. If there is any abnormally high potential existing at the base of the transistor 6, a bypass circuit constituted by the diode 11 will be conducted and the potential will therefore be lowered.

The oscillation within the oscillatory circuit 2 induces a current in secondary winding 92 and a potential rises across this winding. This current charges the capacitor 14 after being rectified by the diode 13. Due to continuous charging, the potential of the capacitor 14 rises. After the potential of the capacitor 14 has risen to a predetermined value, the trigger 16 is triggered and its resistance is reduced abruptly. Therefore, there will be an oscillatory discharge through the circuit (that is, capacitor 14, primary winding 151 and trigger 16). This discharge further induces a high potential current signal in the secondary winding 152, which in turn sparks between electrodes 18*a* and 18*b*. When gas valve 23 is opened and gas flows out through nozzle 201, it is ignited by the sparks between electrodes 18*a* and 18*b*. After the capacitor 14 discharges a certain amount, the potential of the capacitor 14 will be so low that it will not be possible to actuate the trigger 16. Therefore, the oscillatory discharge stops. Then the capacitor 14 gradually re-charges and the oscillatory discharge is repeated again. Therefore, a high potential current signal is induced in the secondary winding 152 of the second transformer 15 repeatedly and electrodes 18*a* and 18*b* spark again and again.

As gas is ignited on nozzle 201, the air molecules between electrodes 18*a* and 18*b* will be ionized due to the high temperture of the flames. Therefore, the flames become conductive. Owing to the conductivity of the flames between electrodes 18*a* and 18*b*, the base of transistor 8 is connected to the ground (via resistor 19, secondary winding 152 and electrodes 18*a* and 18*b*). Therefore, a forward bias forms between the emitter and the base of the transistor 8 and, thus, the transistor 8 is turned on. This, in turn, turns off the transistor 7, because no suitable bias exists any longer at the base of the transistor 7. When the transistor 7 turns off, the oscillatory circuit 2 is opened and the whole action is stopped.

If the flames on nozzle 201 die out or are extinguished, then transistor 8 turns off and transistor 7 turns on again. The phenomenon described hereinabove will repeat itself until the gas from nozzle 201 is re-ignited.

I claim:

1. An automatic electronic ignition system circuit, comprising an oscillatory circuit, a charging circuit and a sparking device, and characterized in that the ignition system circuit has a trigger disposed between a first transformer and a second transformer and being in parallel therewith to control the charging circuit, a neon lamp disposed across two electrodes of said sparking device, one of the sparking electrodes being disposed on a metal outlet, said outlet having gas nozzles and being supplied gas via a gas pipe, said gas nozzles facing the other sparking electrode with a suitable gap therebetween such that the flames being caused by the sparking device between the sparking electrodes are used as a control switch to control the ignition system so as to automatically produce sparks and ignite the gas when the flames for some reason go out and also includes means such that the sparking action is automatically stopped when a flame exists.

2. An ignition system circuit as set forth in claim 1, wherein said oscillatory circuit comprises three transistors—an oscillatory transistor, an amplifying transistor and a control transistor—the base of said control transistor being connected in series with said neon lamp, and a protective diode being disposed between a D.C. source and the base of said oscillatory transistor.

* * * * *